US010159303B2

(12) United States Patent
Wang et al.

(10) Patent No.: US 10,159,303 B2
(45) Date of Patent: Dec. 25, 2018

(54) ANTISTATIC SHOE

(71) Applicant: NEW PROCESS CORP., Taichung (TW)

(72) Inventors: San-Huai Wang, Taichung (TW); Tzu-Yang Wang, Taichung (TW)

(73) Assignee: New Process Corp., Taichung (TW)

( * ) Notice: Subject to any disclaimer, the term of this patent is extended or adjusted under 35 U.S.C. 154(b) by 286 days.

(21) Appl. No.: 15/241,435

(22) Filed: Aug. 19, 2016

(65) Prior Publication Data

US 2018/0049513 A1 Feb. 22, 2018

(51) Int. Cl.

| | |
|---|---|
| ***A43B 7/36*** | (2006.01) |
| ***A43B 3/00*** | (2006.01) |
| ***A43B 13/12*** | (2006.01) |
| *A43B 7/32* | (2006.01) |

(52) U.S. Cl.

CPC ..... *A43B 7/36* (2013.01); *A43B 3/0005* (2013.01); *A43B 13/125* (2013.01); *A43B 7/32* (2013.01); *A43B 13/12* (2013.01); *Y10S 57/901* (2013.01)

(58) Field of Classification Search

USPC ..... 361/212, 220

See application file for complete search history.

(56) References Cited

U.S. PATENT DOCUMENTS 6,721,161 B2 * 4/2004 Lee ..... A43B 7/36 361/223

2002/0089805 A1 * 7/2002 Maritz ..... A43B 7/36 361/224

FOREIGN PATENT DOCUMENTS

TW M361917 U 8/2009

* cited by examiner

*Primary Examiner* — Danny Nguyen

(74) *Attorney, Agent, or Firm* — Wang Law Firm, Inc.

(57) ABSTRACT

An antistatic shoe includes an outsole having a conducting portion that is made of a conducting material and an insole that has a conducting portion mad of a conducting material. An antistatic unit is sewn to the conducting portion of the insole from below so as to be located between the outsole and the insole. An upper is mounted on the outsole and the insole. Electric connection between the components allows static electricity from a human body to be transmitted to a resistor in the antistatic unit, so that static electricity that would otherwise accumulate in the human body can be stably removed by the resistor and sent to the ground. This eliminates the risk of a transient electrostatic discharge that may disadvantageously damage adjacent electronic devices or generate sparks.

8 Claims, 7 Drawing Sheets

ANTISTATIC SHOE

BACKGROUND OF THE INVENTION

1. Technical Field

The present invention relates to footwear and more particularly to an antistatic shoe.

2. Description of Related Art

Referring to FIG. 1, a conventional antistatic shoe as disclosed in Taiwan Utility Model Patent No. M361917 comprises an outsole 10, which may be made of a conducting material and on which a first conducting sheet 11 is provided so that the first conducting sheet 11 exposed at the upper side of the outsole 10; and a pad 20, which has its lower side placed on the upper side of the outsole 10 and includes a body, a lining, an SMD resistor 21 (wherein "SMD" refers to a surface-mount device), an upper conducting sheet and a lower conducting sheet, wherein the body has a through hole, and the lining is placed below the body. The lining has a receiving hole that is aligned with the through hole of the body. The SMD resistor 21 is received in the through hole and the receiving hole. The SMD resistor 21 includes an enveloping layer and two pins. The enveloping layer contains therein a resistive circuit. The two pins are provided at two sides of the enveloping layer and overlaid on the enveloping layer. The two pins are each electrically connected to the resistive circuit, so that one of the pins is exposed at the upper side of the body and the other pin is exposed at the lower side of the lining. The upper conducting sheet is placed on the body from above and covers the pin of the SMD resistor to be electrically connected thereto. The lower conducting sheet is placed below the lining and covers the other pin of the SMD resistor so as to be electrically connected to the first conducting sheet 11 of the outsole 10. The conventional antistatic shoe also comprises a midsole 30, which is provided at the upper side of the outsole 10 so that it works with the outsole 10 to sandwich the pad 20. The midsole 30 has a second conducting sheet 31. The second conducting sheet 31 includes a first segment 311 and a second segment 312 at the upper side of the midsole 30 and a third segment 313 at the lower side of the midsole 30. The third segment 313 of the second conducting sheet 31 is covered by the pad, so as to prevent the third segment 313 from contacting the outsole 10 or the first conducting sheet 11 of the outsole 10 and forming a circuit. The conducting sheet on the pad 20 contacts the third segment 313 of the second conducting sheet 31 so as to form electric connection. The conventional antistatic shoe still comprises an upper mounted on the outsole 10, the pad 20 and the midsole 30. With the configuration described above, static electricity existing between a human body and the midsole 30 and between the outsole 10 and the ground can be transmitted by the SMD resistor 21 to the ground and removed from the human body.

However, the configuration is disadvantageous because when the upper and lower conducting sheets are adhered or sewn to each other, the SMD resistor is not securely positioned, so the conventional antistatic shoe and its insole are not stable in terms of use and manufacturing. Particularly, after repeated tread, it is likely the SMD resistor moves and accidently makes a short circuit or a broken circuit, which invalids the shoe's antistatic performance.

SUMMARY OF THE INVENTION

Hence, it is the objective of the present invention to provide an antistatic shoe that improves the existing antistatic shoes in terms of stability and other defects.

For achieving the foregoing objective, the present invention provides an antistatic shoe, which comprises: an outsole having a conducting portion that is made of a conducting material; an insole having a conducting portion; and an antistatic unit located between the outsole and the insole. The antistatic unit includes a first base made of a nonconducting material and having a first surface and a second surface; a second base made of a nonconducting material and having a first surface and a second surface; a first conducting member provided on the first surface and the second surface of the first base; a second conducting member provided on the first surface of the second base; a third conducting member provided on the first surface and the second surface of the second base, wherein the second conducting member and the third conducting member are not electrically communicated; and a resistor provided on the first surface of the second base, with two ends thereof connected to the second conducting member and the third conducting member.

The first surface of the first base adheres to the first surface of the second base, so that the first conducting member and the second conducting member are electrically communicated. The first conducting member of the second surface of the first base is electrically connected to one of the conducting portion of the insole and the conducting portion of the outsole. The third conducting member of the second surface of the second base is electrically connected to the other of the conducting portion of the outsole and the conducting portion of the insole. There is also an upper connected to the outsole and the insole.

In one embodiment, the antistatic unit further has a fourth conducting member, which is provided on the first surface of the first base and the first surface of the second base, with two ends thereof electrically connected to the first conducting member and the second conducting member.

In one embodiment, the resistor is an SMD resistor.

In one embodiment, the resistor has a resistance of 1MΩ~10MΩ.

In one embodiment, the first base and the second base are connected at adjacent ends thereof so as to form a single base.

In one embodiment, the outsole is made of a conducting material, so the entire outsole is the conducting portion.

In one embodiment, the conducting portion of the insole is located at a bottom or a front end of the insole.

In one embodiment, there is also an upper, which is connected to the outsole.

The antistatic shoe and its insole according to the present invention are structurally firm. When the shoe is in use, or when the insole is trodden, since the second conducting member and the third conducting member are combined with the SMD resistor flatly, the SMD resistor in the antistatic unit is well based while being firmly sewn to the insole, the SMD resistor is prevented from moving under external force. This eliminates the risk of a short circuit or a broken circuit, which invalids the shoe's antistatic performance. Also, it eliminates the risk of a transient electrostatic discharge that may disadvantageously damage adjacent electronic devices or generate sparks.

DETAILED DESCRIPTION OF THE INVENTION

Figure 1:
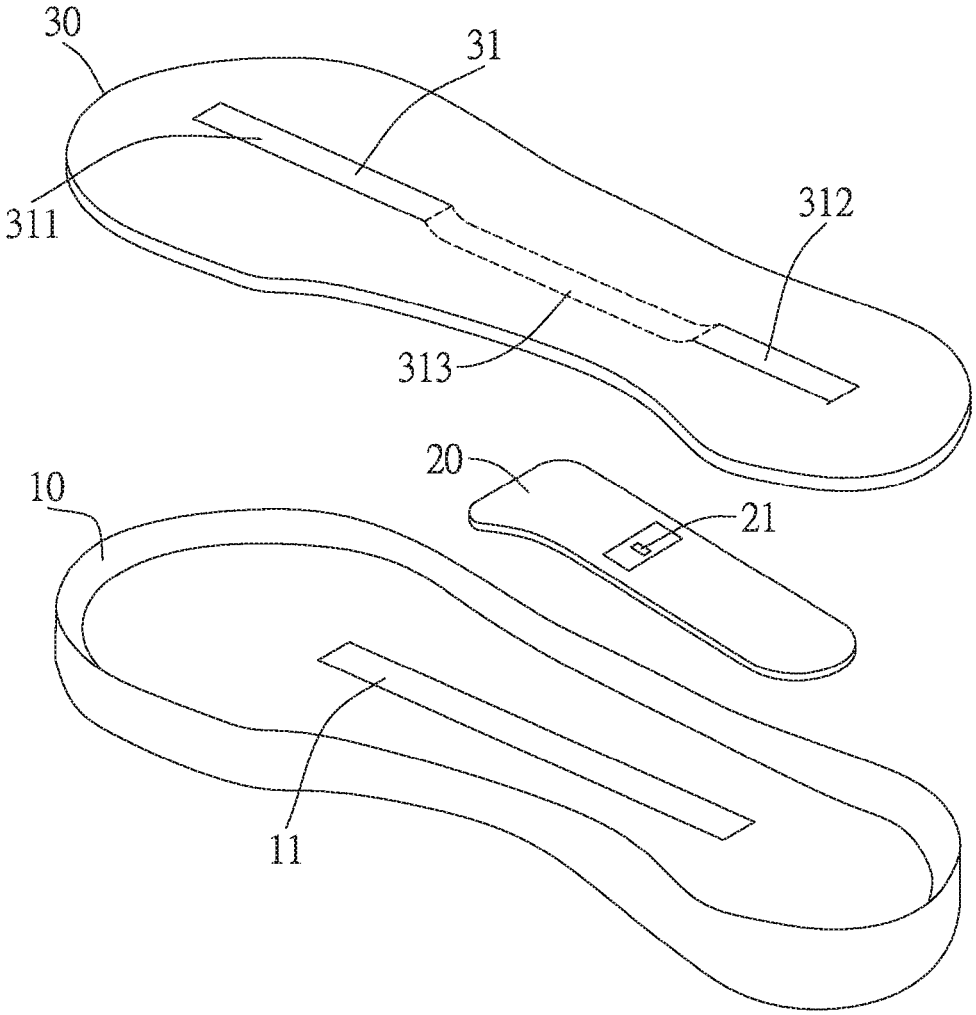
FIG.1 PRIOR ART
FIG. 1 is an exploded view of a prior art.
Figure 2:
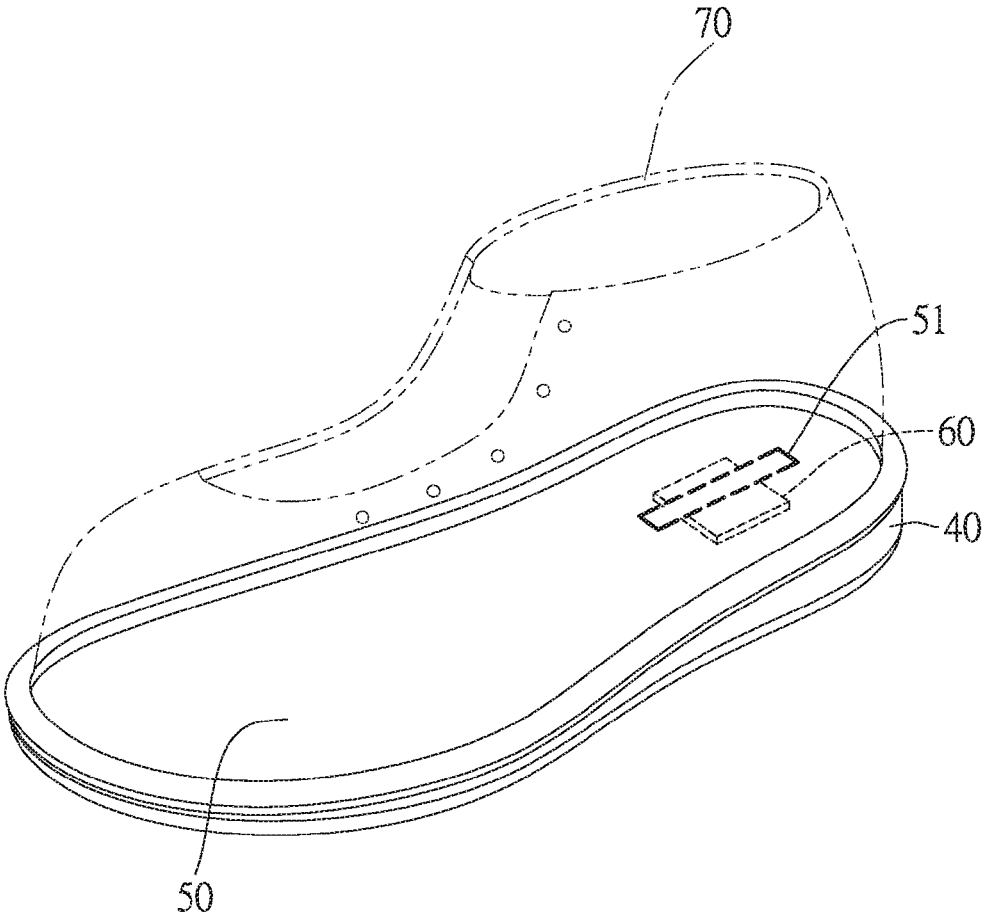
FIG. 2 is a perspective view of a preferred embodiment of the present invention.
Figure 3:
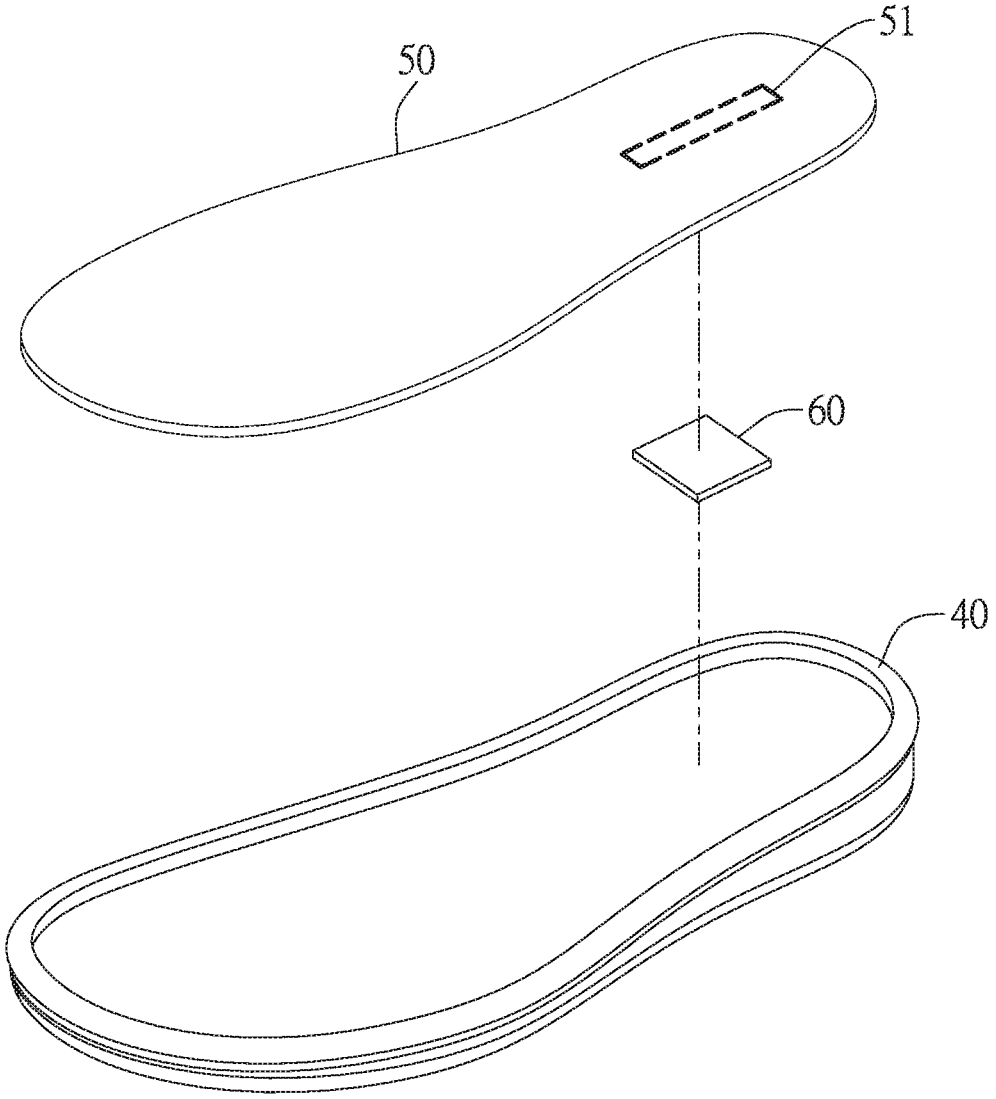
FIG. 3 is an exploded view of a preferred embodiment of the present invention.
Figure 4:
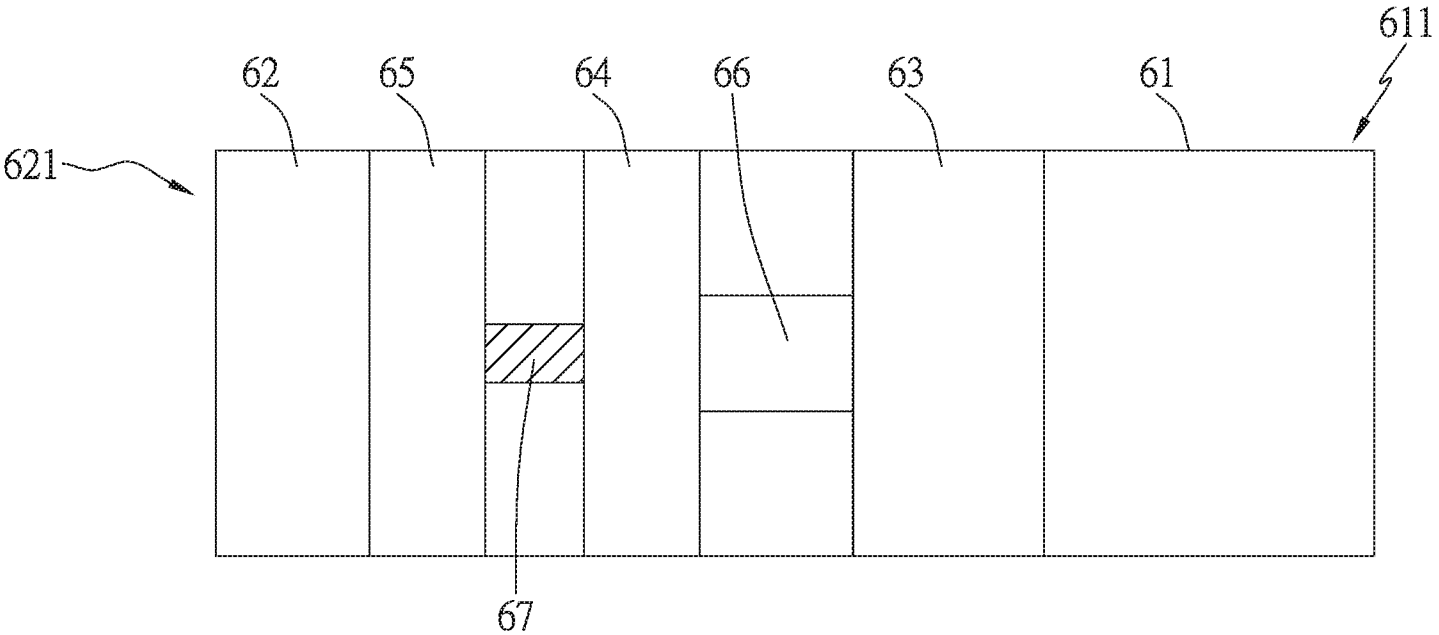
FIG. 4 is a structural drawing of a first surface of an antistatic unit of the present invention.
Figure 5:
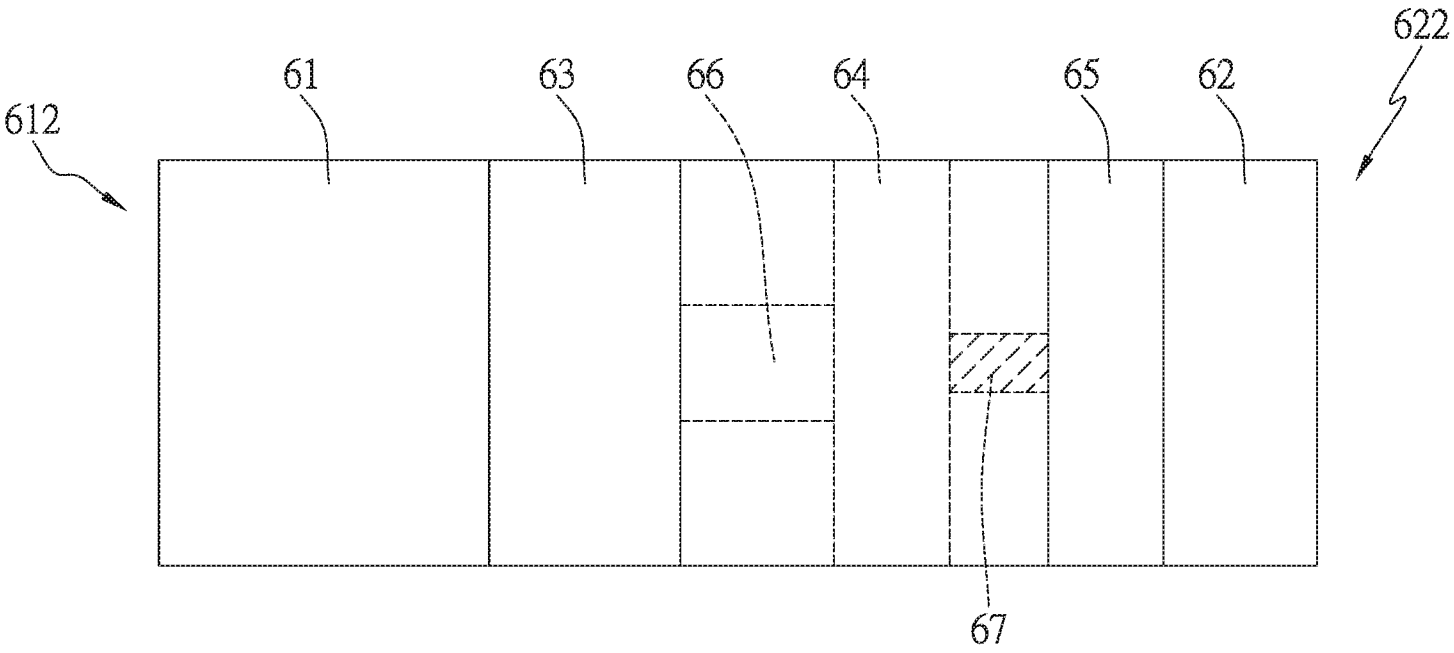
FIG. 5 is a structural drawing of a second surface of an antistatic unit the present invention.
Figure 6:
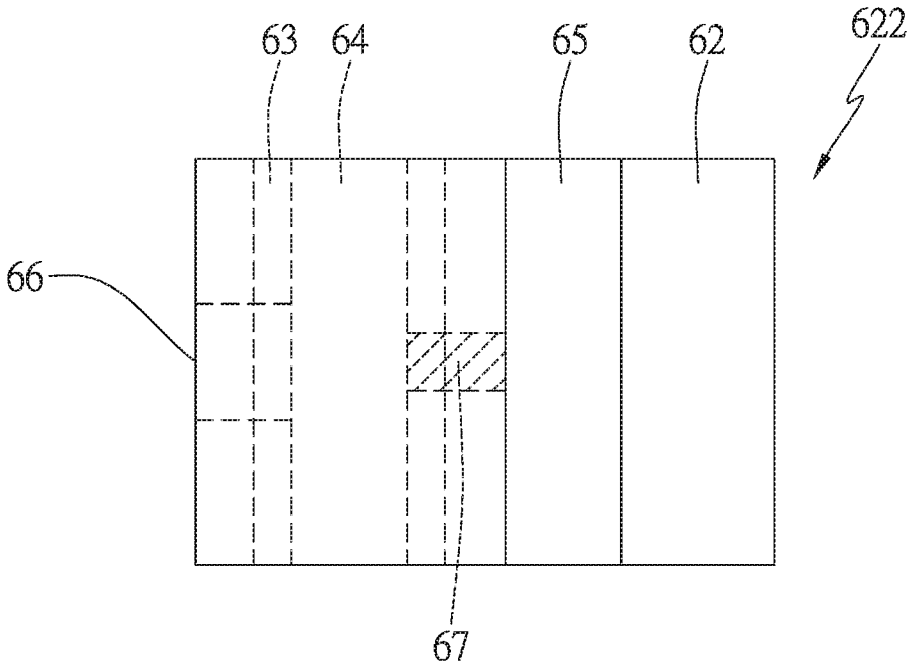
FIG. 6 is a structural drawing of a second surface of a second base of an antistatic unit of the present invention that is folded.
Figure 7:
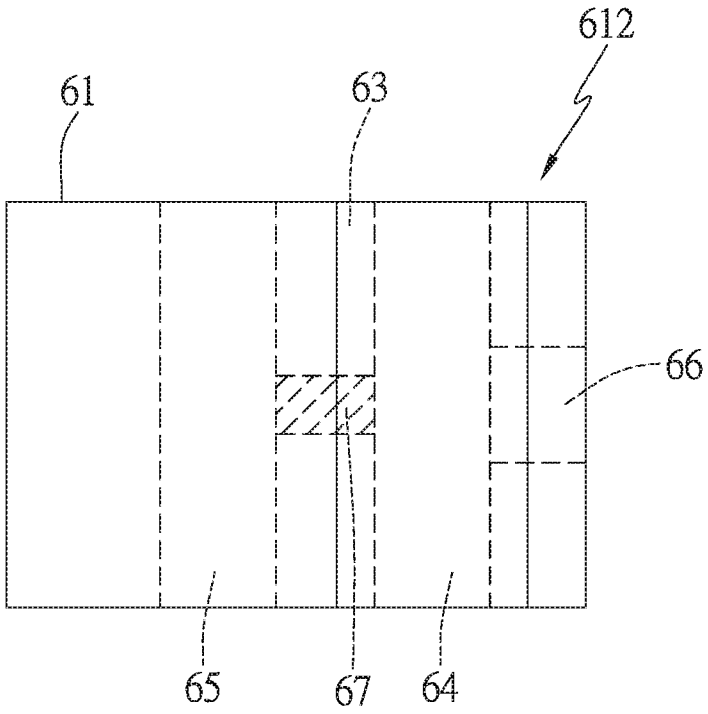
FIG. 7 is a structural drawing of a second surface of a first base of an antistatic unit of the present invention that is folded.

The present invention provides an antistatic shoe, as shown in FIG. 2 through FIG. 7. It comprises an outsole 40, an upper 70 connected to the outsole 40, an insole 50 placed in the upper 70 and an antistatic unit 60.

The outsole 40 has a conducting portion. In the present embodiment, the outsole 40 is made of a conducting material, so the entire outsole 40 acts as the conducting portion.

The insole 50 has a conducting portion 51. In the present embodiment, the insole 50 has its conducting portion 51 located at the bottom or the front end of the insole 50.

The antistatic unit 60 is sewn to the conducting portion 51 of the insole 50 from below and located between the outsole 40 and the insole 50.

The antistatic unit 60 includes a first base 61, which is made of a nonconducting material and has a first surface 611 and a second surface 612.

The antistatic unit 60 includes a second base 62, which is made of a nonconducting material and has a first surface 621 and a second surface 622.

The antistatic unit 60 includes a first conducting member 63 that is provided on the first surface 611 and the second surface 612 of the first base 61.

The antistatic unit 60 includes a second conducting member 64 that is provided on the first surface 621 of the second base 62.

The antistatic unit 60 includes a third conducting member 65 that is provided on the first surface 621 and the second surface 622 of the second base 62. The second conducting member 64 and the third conducting member 65 are not electrically communicated.

The antistatic unit 60 includes a fourth conducting member 66 that is provided on the first surface 611 of the first base 61 and the first surface 621 of the second base 62, with two ends thereof connected to the first conducting member 63 and the second conducting member 64, so as to ensure electric connection between the first conducting member 63 and the second conducting member 64.

The antistatic unit 60 includes a resistor 67. In the present embodiment, the resistor 67 is an SMD resistor installed on the first surface 621 of the second base 62 and having a resistance of 1MΩ~10MΩ, with two ends thereof connected to the second conducting member 64 and the third conducting member 65.

In the present embodiment, the first base 61 and the second base 62 are of the same size and are connected at adjacent ends thereof so as to form a single base. The first surface 611 of the first base 61 adheres to the first surface 621 of the second base 62, so the first conducting member 63 and the second conducting member 64 are electrically communicated. The first conducting member 63 of the second surface 612 of the first base 61 is electrically connected to the conducting portion 51 of the insole 50. The third conducting member 65 of the second surface 622 of the second base 62 is electrically connected to the outsole 40. In another embodiment, the first conducting member 63 of the second surface 612 of the first base 61 is electrically connected to the outsole 40, and the third conducting member 65 of the second surface 622 of the second base 62 is electrically connected to the conducting portion 51 of the insole 50. This also provides the same effect.

When a user in the shoe has his/her body collecting or generating static electricity due to contact, friction or external conduction, the static electricity can be stably transmitted through the conducting portion 51 of the insole 50, the first conducting member 63 of the antistatic unit 60, to the second conducting member 64. Then the SMD resistor 67 modulates and removes the static electricity by stably conducting it to the outsole 40 and in turn to the ground. The SMD resistor 67 also provides a certain level of protection against electric shocks.

To sum up, the antistatic shoe of the present invention is structurally firm. When the shoe is in use, or when the insole is trodden, since the second conducting member 64 and the third conducting member 65 are combined with the SMD resistor 67 flatly, the SMD resistor 67 in the antistatic unit 60 is well based while being firmly sewn to the insole 50, the SMD resistor 67 is prevented from moving under external force. This eliminates the risk of a short circuit or a broken circuit, which invalids the shoe's antistatic performance. In addition, as the human body acts as a medium, discharge from electronic devices or transient electrostatic discharge that may disadvantageously generate sparks is also prevented. As a result, the antistatic show and its insole are more endurable and more stable as compared to the prior art. This fact in turn means reduced costs and replacement. In conclusion, the disclosed shoe can effectively release static electricity and provide protection against electric shocks, thereby ensuring working safety.

What is claimed is:

1. An antistatic shoe, comprising:

an outsole, having a conducting portion;

an insole, having a conducting portion; and an antistatic unit, which is deposited between the outsole and the insole and includes:

a first base, which is made of a nonconducting material and has a first surface and a second surface;

a second base, which is made of a nonconducting material and has a first surface and a second surface;

a first conducting member, which is provided on the second surface of the first surface of the first base;

a second conducting member, which is provided on the first surface of the second base;

a third conducting member, which is provided on the first surface and the second surface of the second base, wherein the second conducting member and the third conducting member are not electrically communicated; and a resistor, which is provided on the first surface of the second base, with two ends thereof electrically connected to the second conducting member and the third conducting member, wherein, the first surface of the first base adheres to the first surface of the second base, so that the first conducting member and the second conducting member are electrically communicated, and the first conducting member of the second surface of the first base is electrically connected to one of the conducting portion of the insole and the conducting portion of the outsole, while the third conducting member of the second surface of the second base is electrically connected to the other of the conducting portion of the outsole and the conducting portion of the insole.

2. The antistatic shoe of claim 1, wherein the antistatic unit further has a fourth conducting member, which is provided on the first surface of the first base and the first surface of the second base, with two ends thereof electrically connected to the first conducting member and the second conducting member.

3. The antistatic shoe of claim 1, wherein the resistor is an SMD resistor.

4. The antistatic shoe of claim 1, wherein the resistor has a resistance of 1MΩ~10MΩ.

5. The antistatic shoe of claim 1, wherein the first base and the second base are connected at adjacent ends thereof so as to form a single base.

6. The antistatic shoe of claim 1, wherein the outsole is made of a conducting material, so the entire outsole is the conducting portion.

7. The antistatic shoe of claim 1, wherein the conducting portion of the insole is located at a bottom or a front end of the insole.

8. The antistatic shoe of claim 1, further comprising an upper, which is connected to the outsole.

* * * * *